US011619893B2

(12) United States Patent
Arai

(10) Patent No.: US 11,619,893 B2
(45) Date of Patent: Apr. 4, 2023

(54) IMAGE FORMING DEVICE AND CONTROLLING METHOD

(71) Applicant: Konica Minolta, Inc., Tokyo (JP)

(72) Inventor: Junichi Arai, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 60 days.

(21) Appl. No.: 17/498,125

(22) Filed: Oct. 11, 2021

(65) Prior Publication Data

US 2022/0113653 A1 Apr. 14, 2022

(30) Foreign Application Priority Data

Oct. 13, 2020 (JP) ..... JP2020-172361

(51) Int. Cl.
*G03G 15/08* (2006.01)
*G03G 15/00* (2006.01)

(52) U.S. Cl.
CPC ..... *G03G 15/0863* (2013.01); *G03G 15/086* (2013.01); *G03G 15/0856* (2013.01); *G03G 15/0858* (2013.01); *G03G 15/0865* (2013.01); *G03G 15/0867* (2013.01); *G03G 15/0872* (2013.01); *G03G 15/0877* (2013.01); *G03G 15/0879* (2013.01); *G03G 15/5016* (2013.01); *G03G 2215/066* (2013.01); *G03G 2215/067* (2013.01); *G03G 2215/0663* (2013.01); *G03G 2215/0695* (2013.01); *G03G 2215/0697* (2013.01); *G03G 2215/0888* (2013.01)

(58) Field of Classification Search
CPC ..... G03G 15/0856; G03G 15/0858; G03G 15/086; G03G 15/0863; G03G 15/0865; G03G 15/0867; G03G 15/0872; G03G 15/0877; G03G 15/0879; G03G 15/5016; G03G 2215/066; G03G 2215/067; G03G 2215/0663; G03G 2215/0695; G03G 2215/0697; G03G 2215/0888
See application file for complete search history.

(56) References Cited

U.S. PATENT DOCUMENTS 5,307,129 A * 4/1994 Miura ..... G03G 15/0893 222/DIG. 1
2004/0086286 A1* 5/2004 Ishii ..... G03G 15/0889 399/27
2006/0133835 A1 6/2006 Kimura et al.
2015/0177681 A1* 6/2015 Yamada ..... G03G 21/1652 399/13
2018/0299815 A1 10/2018 Sakaguchi et al.

FOREIGN PATENT DOCUMENTS

JP 2006-145765 6/2006
JP 2018-180294 11/2018

* cited by examiner

*Primary Examiner* — Joseph S Wong
(74) *Attorney, Agent, or Firm* — BakerHostetler

(57) ABSTRACT

An image forming device may comprise: an attaching unit to which a removable toner bottle is attached; a toner storage that stores toner supplied from the toner bottle attached to the attaching unit; a detector that detects an empty state of toner in the toner storage; and a hardware processor that: supplies toner to the toner storage from the toner bottle when the toner bottle attached to the attaching unit is new; and switches a state of the toner bottle to an old state from a new state if the empty state detected by the detector is released.

27 Claims, 15 Drawing Sheets

FIG. 8

| | VOLTAGE AT POINT A |
|---|---|
| BEFORE CUTTING FUSE | HIGH |
| AFTER CUTTING FUSE | LOW |

IMAGE FORMING DEVICE AND CONTROLLING METHOD

CROSS-REFERENCE TO RELATED APPLICATIONS

Japanese patent application No. 2020-172361 was filed on Oct. 13, 2020, the entire disclosure of which being incorporated herein by reference.

BACKGROUND

Technological Field

The present disclosure relates to an image forming device and a controlling method. The present disclosure more specifically relates to a technique for controlling operations when a toner bottle is replaced in the image forming device.

Description of the Related Art

Electrophotographic image forming devices such as printers or MFPs (Multifunction Peripherals) are provided with attaching units to which toner bottles are attached. Toner is supplied to a developing unit from the toner bottle attached to the attaching unit. When aggregation of toner occurs inside the toner bottle attached to the attaching unit of this type of the image forming device, the toner has low fluidity and the toner cannot be normally supplied to the developing unit from the toner bottle. When toner cannot be normally supplied to the developing unit from the toner bottle, an image forming device conventionally guides the user of an operation to take the toner bottle out, rapidly shake it and reattach it. This known technique is introduced for example in Japanese Patent Application Laid-Open No. JP 2018-180294 A.

Toner bottles on which fuses are mounted are conventionally known for identification of new and old toner bottles. When the toner bottle is new, the fuse is shifted to an electrically conductive state once the toner bottle is attached to the attaching unit of the image forming device. The image forming device verifies the conductive state of the fuse, and detects the toner bottle is new. The image forming device then cuts the fuse and updates a remaining toner quantity to a full-up state. As the remaining toner quantity is updated to the full-up state, a user is enabled to confirm that the toner is recovered from an empty state.

When the toner bottle is not stored in a good condition, aggregation of the toner occurs inside the toner bottle. When the toner bottle is stored vertically, the aggregation of the toner is likely to be caused and the toner filled inside may become hard. The aggregation of toner may cause due to some environmental conditions such as temperature or humidity of a location in which the toner bottle is stored. It is stated in advance as an operation procedure for attachment of the new toner bottle to the image forming device to shake the toner bottle rapidly to improve the fluidity of toner.

The user who does not know the operation procedure well may replace the toner bottle to the new one. In such a case, the user may attach the new toner bottle to the image forming device as it is stored without shaking it. The image forming device detects that the toner bottle is new so that it cuts the fuse and updates the remaining toner quantity to the full-up state. Even the image forming device tries to supply toner to the developing unit from the toner bottle, toner is not supplied. Thus, the remaining toner quantity is gone back to the empty state immediately.

The user notices that he or she has forgotten to shake the toner bottle as the remaining toner quantity goes back to the empty state immediately even still he or she has attached the new toner bottle. The user then takes the toner out from the image forming device and attaches again the toner bottle after he or she shakes it sufficiently. The image forming device, however, may not detect the toner bottle which is attached again as the new toner bottle. The image forming device cannot put the remaining toner quantity back to the full-up state even still the enough amount of toner is filled in the toner bottle.

SUMMARY

The present disclosure is intended to solve one or more of the above problems. Thus, the present disclosure is intended to provide an image forming device and a controlling method that may be enabled to appropriately detect a new or an old toner bottle even when the toner bottle is once taken out and attached again.

First, the present disclosure is directed to an image forming device.

To achieve at least one of the abovementioned objects, according to an aspect of the present disclosure, the image forming device reflecting one aspect of the present disclosure may comprise: an attaching unit to which a removable toner bottle is attached; a toner storage that stores toner supplied from the toner bottle attached to the attaching unit; a detector that detects an empty state of toner in the toner storage; and a hardware processor that: supplies toner to the toner storage from the toner bottle when the toner bottle attached to the attaching unit is new; and switches a state of the toner bottle to an old state from a new state if the empty state detected by the detector is released.

Second, the present disclosure is directed to a controlling method, which may be applied in an image forming device, comprising: an attaching unit to which a removable toner bottle is attached; a toner storage that stores toner supplied from the toner bottle attached to the attaching unit; and a detector that detects an empty state of toner in the toner storage.

According to an aspect of the present disclosure, the controlling method may comprise: supplying toner to the toner storage from the toner bottle when the toner bottle attached to the attaching unit is new; and switching a state of the toner bottle to an old state from a new state if the empty state detected by the detector is released.

BRIEF DESCRIPTION OF THE DRAWING

The advantages and features provided by one or more embodiments of the disclosure will become more fully understood from the detailed description given herein below and the appended drawings which are given by way of illustration only, and thus are not intended as a definition of the limits of the present disclosure.

FIG. 8 illustrates an example of a voltage at a detection point before a fuse is cut and after the fuse is cut;

DETAILED DESCRIPTION OF EMBODIMENTS

Hereinafter, one or more embodiments of the present disclosure will be described with reference to the drawings. However, the scope of the disclosure is not limited to the disclosed embodiments.

First Embodiment

Figure 1:
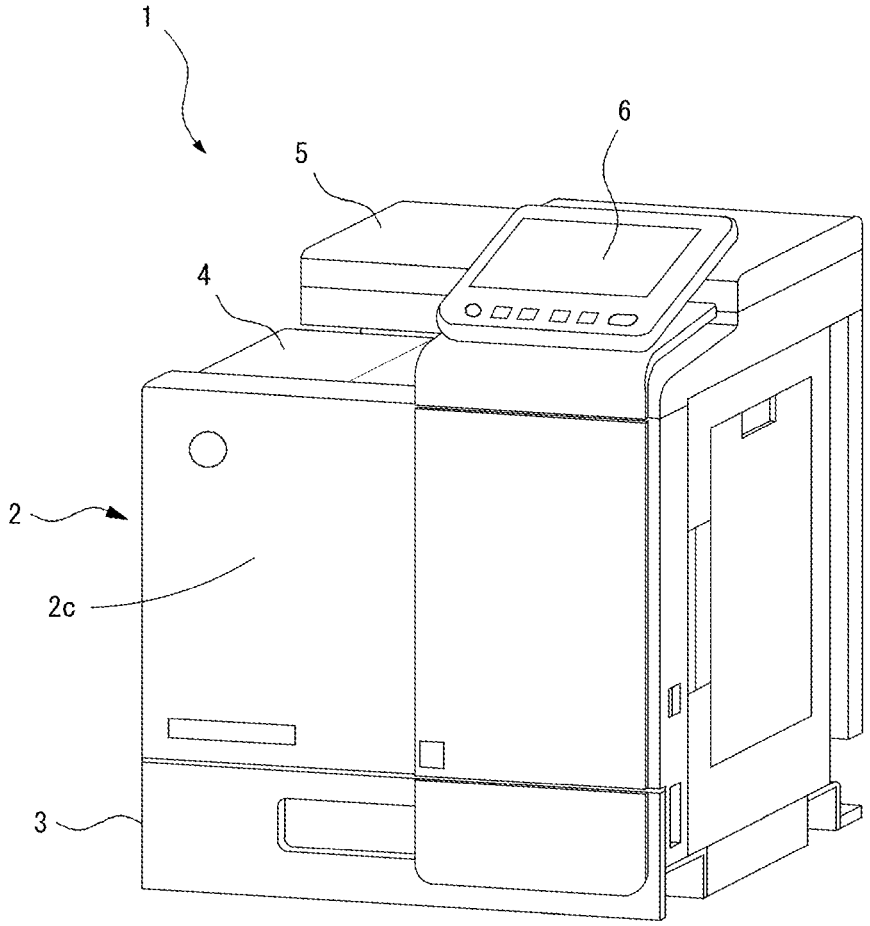
FIG. 1 illustrates an exemplary structure of an image forming device.

FIG. 1 illustrates an exemplary structure of an image forming device 1 in which the first embodiment of the present disclosure may be practiced. The image forming device 1 is constructed as one of MFPs that include multiple functions including, for example, copy function, scan function and print function.

The image forming device 1 is provided with a printer section 2 in the center of the device body. The printer section 2 includes a paper feeding cassette 8 in its lower part. The paper feeding cassette 3 has a paper feeding tray 10 (see FIG. 2) inside. By pulling out the paper feeding cassette toward the front side of the device body, a bundle of the sheets 9 such as print papers can be stored into the paper feeding tray 10. The printer section 2 forms an image on the sheet 9 fed from the paper feeding tray 10 in electrophotography. The printer section 2 transfers a toner image based on image data to print on the sheet 9 and fixes the toner image on the sheet 9. The printer section 2 then ejects the sheet 9 on a paper discharging tray 4. In its front side, the printer section 2 has a door member 2*c* that can be opened and closed for replacement of a toner bottle (see FIG. 2) attached inside.

The image forming device 1 is provided with a scanner section 5 and an operational panel 6 in an upper part of the printer section 2. The scanner section 5 optically reads an image of a document placed by a user and generates image data. When the user instructs processing of a copy job, the scanner section 2 reads the document and generates the image data. The printer section 2 then forms an image on the sheet 9 based on the image data. The operational panel 6 serves as a user interface for the user to operate the image forming device 1. The operational panel 6 displays various types of screens to the user and accepts operations by the user.

Figure 2:
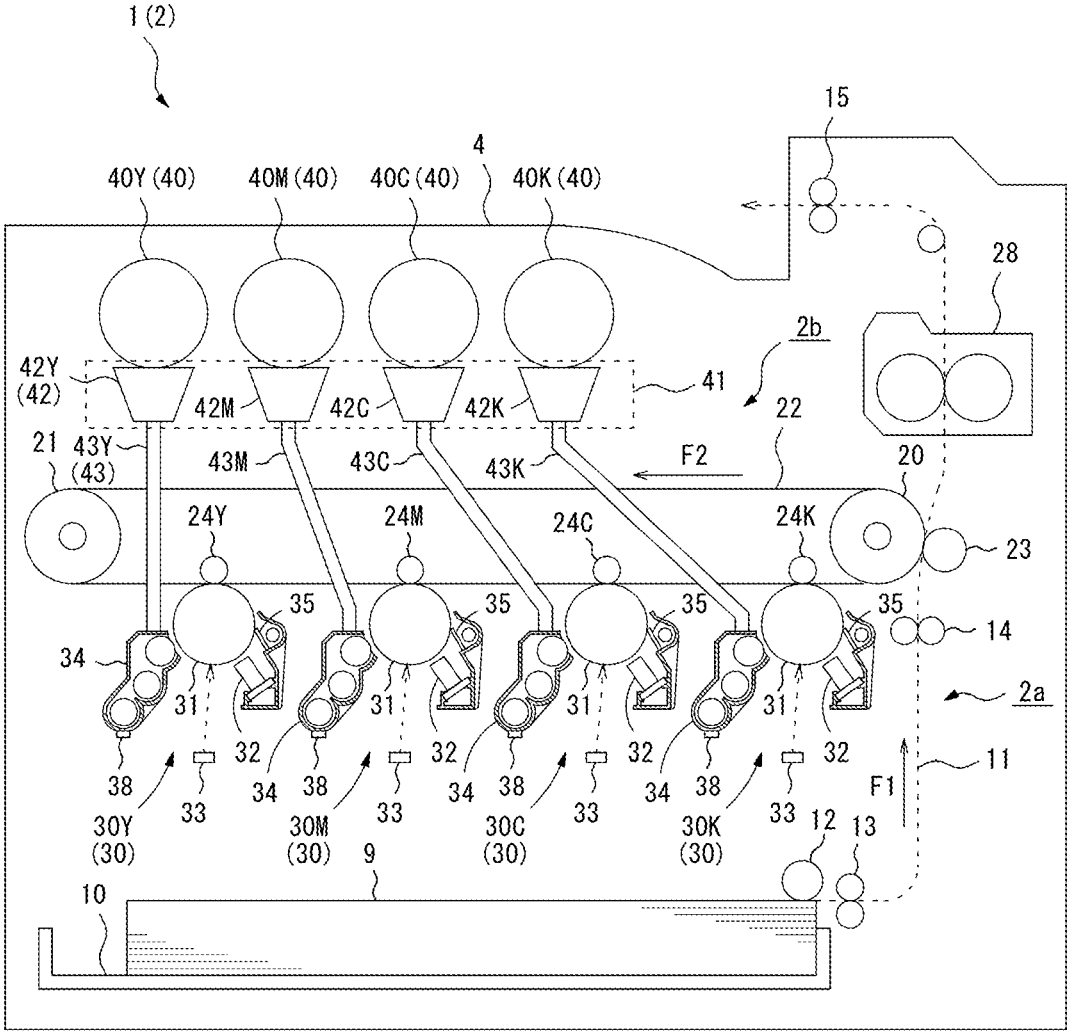
FIG. 2 illustrates an internal structure of a printer section.

FIG. 2 illustrates an internal structure of the printer section 2. The printer section 2 includes a sheet feeding mechanism 2*a* and an image forming mechanism 2*b*.

The sheet feeding mechanism 2*a* takes the single sheet 9 from a top of the bundle of the sheets 9 stored in the paper feeding tray 10, and feeds the sheet 9 toward an arrow direction F1 along a carrying path 11 shown with a broken line in FIG. 2. The sheet feeding mechanism 2*a* sends the single sheet 9 stored in the paper feeding tray 10 out to the carrying path 11 with a pick-up roller 12 and a feeding roller 13. A timing toller 14, a secondary transfer roller 23, a fixing unit 28 and a paper discharging roller 15 are arranged on the carrying path 11. The sheet 9 carried along the carrying path 11 once stops at a position of the timing roller 14. The sheet 9 is then supplied toward the secondary transfer toller 23 at timing that a toner image primarily transferred on an intermediate transfer belt 22 by the image forming mechanism 2*b* reaches a position of the secondary transfer roller 23. As a result, when the sheet 9 passes the position of the secondary transfer roller 23, the toner image primarily transferred on the intermediate transfer belt 22 is secondarily transferred on a surface of the sheet 9. A heating process and a pressure process are carried out on the sheet 9 on which the toner image is transferred when it passes the fixing unit 28 so that the toner image is fixed on the surface of the sheet 9. The sheet 9 on which the toner image is fixed is discharged on the paper discharging tray 4 which is in the upper part of the printer section 2 from the paper discharging roller 15.

The image forming mechanism 2*b* includes a driving roller 20, a driven roller 21, the intermediate transfer belt 22, the secondary transfer roller 23, image forming units 30Y, 30M, 30C and 30K, primary transfer rollers 24Y, 24M, 24C and 24K, toner bottles 40Y, 40M, 40C and 40K, a sub-hopper unit 41 and joints 43Y, 43M, 43C and 43K. The image forming units 30Y, 30M, 30C and 30K are separately arranged corresponding to the respective colors, Y (yellow), M (magenta), C (cyan) and K (black). The primary transfer rollers 24Y, 24M, 24C and 24K arranged opposed to each image forming units 30Y, 30M, 30C and 30K across the intermediate transfer belt 22. Each toner bottle 40Y, 40M, 40C and 40K corresponding to each color Y, M, C and K is attachable to the printer section 2. The sub-hopper unit 41 is arranged in a lower position of the toner bottles 40Y, 40M, 40C and 40K. The joints 43Y, 43M, 43C and 43K are connected to supply toner to each image forming unit 30Y, 30M, 30C and 30K from the sub-hopper unit 41.

The driving roller 20 is arranged opposed to the secondary transfer roller 23 across the carrying path 11 of the sheet 9. The driving roller 20 is driven to rotate in a predetermined direction (counter clock wise direction) by a motor not illustrated in FIG. 2. The driven roller 21 is arranged at a position separated from the driving roller 20 at about the same height position as the driving roller 20. The intermediate transfer belt 22 is an endless belt stretched over the driving roller 20 and the driven roller 21. The driven roller 21 is energized in a direction away from the driving roller 20 (left direction in FIG. 2) by a spring that is not illustrated in FIG. 2, so that tension is applied to the intermediate transfer belt 22. The driving roller 20 rotates in the predetermined direction, and the intermediate transfer belt 22 circulates and moves in an arrow F2 direction of FIG. 2. The driven roller 21 is also driven and rotated. The intermediate transfer belt 22 is formed from a resin material such as, for instance, polycarbonate, polyimide, polyimide-amic.

In the lower part of the intermediate transfer belt 22, the image forming units 30Y, 30M, 30C and 30K corresponding to the respective colors, Y, M, C and K are arranged at predetermined intervals. Each of the image forming unit 30Y, 30M, 30C and 30K has the different color of toner but the detailed structure and operations are the same. When each of the image forming units 30Y, 30M, 30C and 30K of the color is not distinguished, it may be simply referred as the "image forming unit 30."

The image forming unit 30 includes a photoreceptor drum 31 arranged opposed to each of the primary transfer roller 24C, 24M, 24C and 24K across the intermediate transfer belt 22. The photoreceptor drum 31 is an image carrier on which a photosensitive layer is formed on a surface of the cylindrical drum. A cleaner 35, an electrifying unit 32, an exposure unit 33 and a developing unit 34 are arranged around the photoreceptor drum 31. The cleaner 35 is to remove the toner remaining on the surface of the photoreceptor drum 31 which is not primarily transferred on the intermediate transfer belt 22. The photosensitive layer of the surface of the photoreceptor drum 31 is electrified to a predetermined charges by the electrifying unit 32. The exposure unit 33 is constructed by a semiconductor laser or a light emitting diode, for instance, and exposes the photosensitive layer electrified to the predetermined charges based on the image data to draw so that an electrostatic latent image is formed on the surface of the photoreceptor drum 31. The developer includes toner is filled inside the developing unit 34. The developing unit 34 applies the developer to the surface of the photoreceptor drum 31 to make the electrostatic latent image formed by the exposure unit 33 visible with toner. As a result, the toner image is formed on the surface of the photoreceptor drum 31.

The toner image formed on the surface of the photoreceptor drum 31 is primarily transferred on the intermediate transfer belt 22 when the intermediate transfer belt 22 passes between the photoreceptor drum 31 and the primary transfer rollers 24C, 24M, 24C and 24K. This operation is carried out by the image forming units 30Y, 30M, 30C and 30K of the respective colors one after the other so that the toner image in each Y, M, C and K is transferred on top of the other one by one on the intermediate transfer belt 22. A color image is thus formed. The color image is secondarily transferred on the sheet 9 when the sheet 9 passes through a nip part between the intermediate transfer belt 22 and the secondary transfer roller 23. The toner remaining on the intermediate transfer belt 22 that is not secondarily transferred on the sheet 9 is recovered with a cleaning member.

In an upper part of the intermediate transfer belt 22, the toner bottles 40Y, 40M, 40C and 40K of the respective colors and the sub-hopper unit 41 are arranged. The sub-hopper unit 41 has sub-hoppers 42Y, 42M, 42C and 42K corresponding to the respective colors, Y, M, C and K. The toner bottles 40Y, 40M, 40C and 40K of the respective colors supply toner to the sub-hoppers 42Y, 42M, 42C and 42K corresponding to the respective colors, Y, M, C and K. The joints 43Y, 43M, 43C and 43K to which toner can be supplied are connected to the sub-hoppers 42Y, 42M, 42C and 42K of the respective colors. Toner is supplied to the developing unit 34 of each image forming unit 30Y, 30M, 30C and 30K of each color via the joint 43Y, 43M, 43C or 43K from the sub-hopper 42Y, 42M, 42C or 42K of the corresponding color. The sub-hoppers 42Y, 42M, 42C and 42K are capable of storing a predetermined quantity of toner inside. A toner density sensor 38 is provided with the developing unit 34 of each image forming unit 30Y, 30M, 30C and 30K to detect the toner density inside the developing unit 34. When the toner density decrease occurs inside the developing unit 34, toner is supplied to the developing unit 34 from the sub-hopper 42Y, 42M, 42C or 42K via the joint 43Y, 43M, 43C or 43K. Once the remaining toner quantity inside the sub-hopper 42Y, 42M, 42C or 42K is reduced, toner is supplied to the sub-hopper 42Y, 42M, 42C or 42K from the toner bottle 40Y, 40M, 40C or 40K.

The remaining toner quantity inside the sub-hopper 42Y, 42M, 42C or 42K may still not be increased even still toner is supplied to the sub-hopper 42Y, 42M, 42C or 42K from the toner bottle 40Y, 40M, 40C or 40K. In this case, it is detected that toner inside the toner bottle 40Y, 40M, 40C or 40K is all supplied and finished. The user is guided to replace the toner bottle 40Y, 40M, 40C or 40K. Thus, the user replaces the toner bottle 40Y, 40M, 40C or 40K.

In descriptions below, the toner bottles 40Y, 40M, 40C and 40K of the respective colors may be called "toner bottle 40" unless each of them needs to be distinguished. In descriptions below, the sub-hoppers 42Y, 42M, 42C and 42K of the respective colors may be called "sub-hopper 42" unless each of them needs to be distinguished. Further, in descriptions below, the joints 43Y, 43M, 43C and 43K of the respective colors may be called "joint 43" unless each of them needs to be distinguished.

Figure 3:
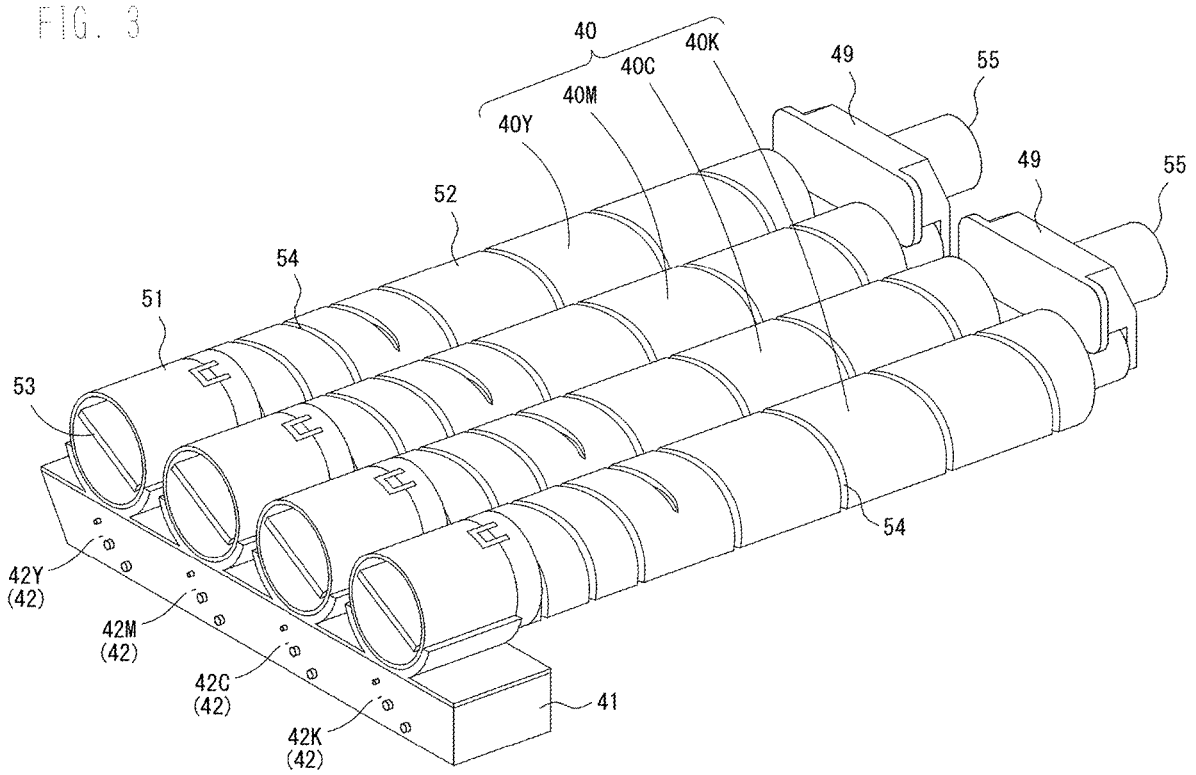
FIG. 3 illustrates a perspective view of multiple toner bottles and a sub-hopper unit.

FIG. 3 illustrates a perspective view of the multiple toner bottles and the sub-hopper unit 41. The toner bottle 40, for example, has an almost cylindrical shape and has a bottle unit 52 and a cap unit 51. Toner is stored in the bottle unit 52 and the cap unit 51 is arranged in an edge of the bottle unit 52. The bottle unit 52 and the cap unit 51 are attached so that they are enabled to relatively rotate. In the front side of the cap unit 51, a knob is formed to rotate the toner bottle 40. The cap unit 51 of the toner bottle 40 of the corresponding color is placed in the upper side of the sub-hopper unit 41 which includes the sub-hoppers 42Y, 42M, 42C and 42K of the respective colors formed integrally.

On the back side of the toner bottle 40, an attachment 49 that holds the toner bottle 40 rotatable is arranged. The attachment 49 is arranged at a predetermined position inside the printer section 2. The attachment 49 attaches the removable toner bottle 40. On the back side of the attachment 49, a driving source 55 like a motor that rotates the bottle unit 52 of the toner bottle 40 is arranged. In FIG. 3, two driving sources 55 are arranged for the attachment 49. One of the two driving sources 55 is enabled to rotate the toner bottles 40 of two colors. A clutch mechanism that is not illustrated in FIG. 3 selectively switches to one of the toner bottles 40 of two colors and rotates the switched toner bottle 40. The bottle unit 52 is rotated by the driving source 55 so that toner stored in the bottle unit 52 is stirred and guided to the direction that has the cap unit 51 by a spiral groove 54 formed on the inner peripheral of the bottle unit 52.

Figure 4:
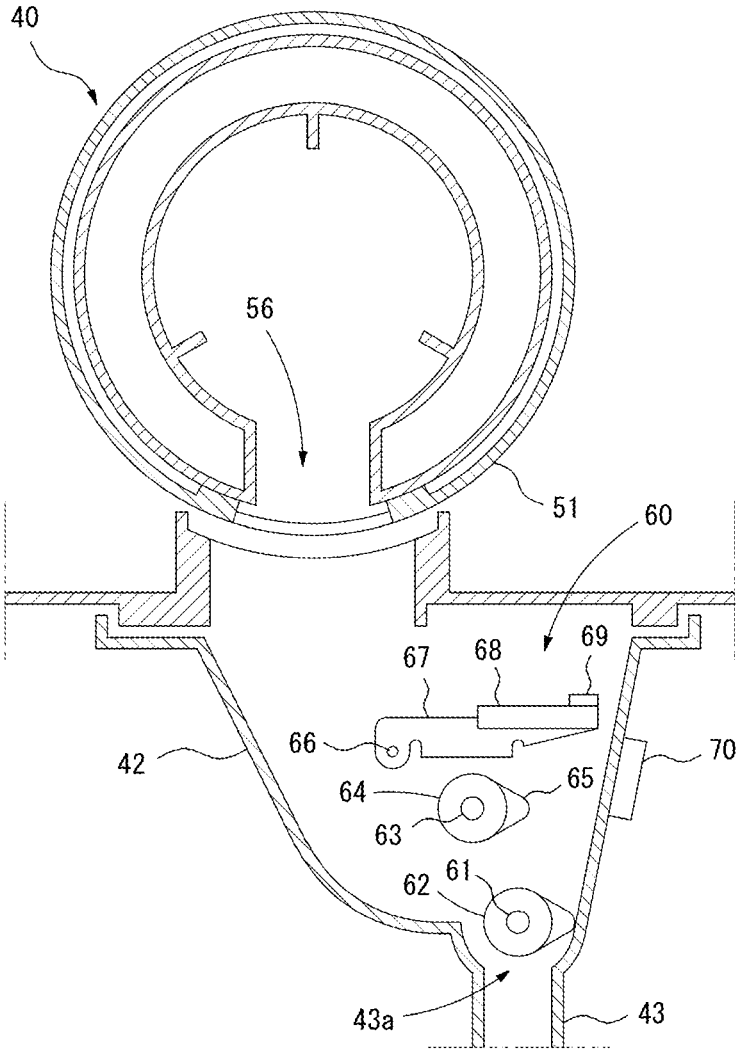
FIG. 4 illustrates an overall structure of a cap unit of the toner bottle and a sub-hopper.

FIG. 4 illustrates an overall structure of the cap unit 51 of the toner bottle 40 and the sub-hopper 42. Inside the cap unit 51 of the toner bottle 40, a supply opening 56 through which toner is supplied to the sub-hopper 42 is formed. To be more specific, once the toner bottle 40 is attached to the attachment 49, the supply opening 56 is positioned in the upper part of the sub-hopper 42. An outer peripheral of the cap unit 51 serves as a shutter that opens and closes the supply opening 56. The outer peripheral of the cap unit 51 is relatively rotated toward inside so that the supply opening 56 opens and toner stored in the bottle unit 52 can be supplied to the sub-hopper 42. In this state, the bottle unit 52 rotates so that toner moved toward the cap unit 51 is dropped and supplied to the sub-hopper 42 from the supply opening 56.

The sub-hopper 42 is formed to a funnel shape and has a toner storage 60 that stores toner supplied from the toner bottle 40. Inside the toner storage 60, a float member 67 that detects un upper surface level of toner is arranged swingably centered on an axis 66. The float member 67 includes a floating unit 68 at a position separated from the axis 66 a predetermined distance. The floating unit 68 moves up and down depending on the variation of the upper surface level of toner stored in the toner storage 60. On the upper surface of the floating unit 68, a magnet 69 is attached. The magnet 69 moves up and down at a position near a wall of the toner storage 60 as well as the up and down movement of the floating unit 68.

An empty sensor 70 is attached to the outer side of the wall near which the magnet 69 moves up and down. The empty sensor 70 is a detector that detects an empty state of toner stored in the toner storage 60. More specifically, when the remaining toner quantity in the toner storage 60 gets less than a predetermined quantity, the empty sensor 70 detects that the toner storage 60 is empty. The empty sensor 70 is formed from a lead switch, for example. The empty sensor 70 switches between on and off depending on the position of the magnet 69 arranged on the upper surface of the floating unit 68.

A stirring member 64 is arranged in a lower part of the floating member 67. The stirring member 64 rotates centered on a predetermined rotation axis 63 so that toner inside the toner storage 60 is stirred. The rotation axis 63 is rotated and driven by a driving resource such as a motor which is not illustrated in FIG. 4. The stirring member 64 includes a cam 65 that rotates centered on the rotation axis 63. The stirring member 64 rotates and the cam 65 rotates, then the cam 65 repeatedly gets in contact and separated from the lower surface of the floating member 67 on a periodical basis. Due to the rotation of the cam 65, a floating member 704 swings up and down.

The lower part of the toner storage 60 is connected to the joint 43. A supply opening 43*a* that supplies toner to the joint 43 includes a supply roller 62. The supply roller 62 rotates together with a rotation axis 61 that is rotated and driven by a driving resource such as a motor which is not illustrated in FIG. 4, and supplies toner to the developing unit 34 via the joint 43. The supply roller 62 can supply a predetermined quantity of toner to the developing unit 34 by a single rotation, for instance. The quantity of toner that is supplied to the developing unit 34 is managed by the number of rotations.

Figure 5A:
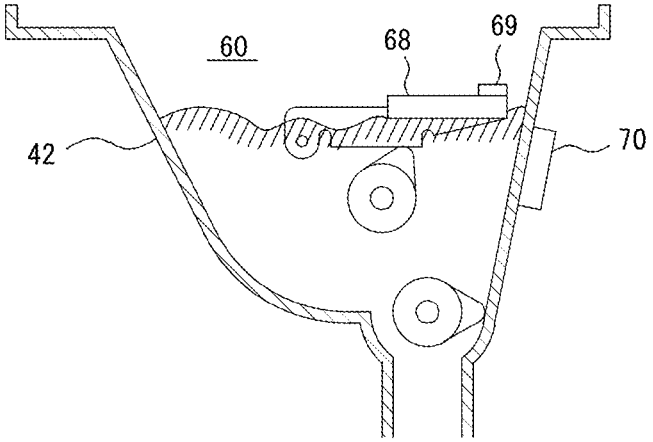
FIGS. 5A and 5B illustrate fluctuations of a floating unit corresponding to a toner quantity.
Figure 5B:
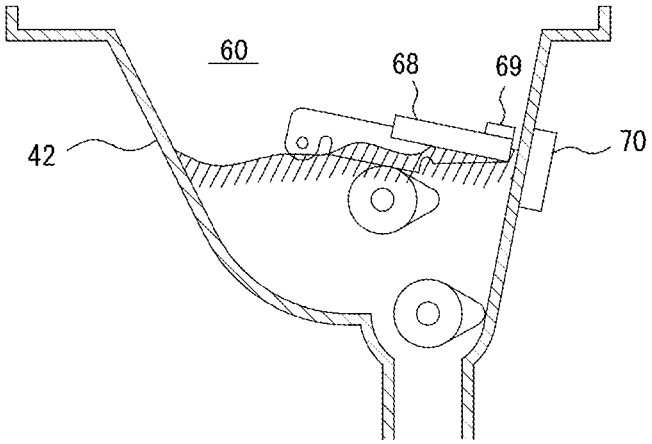

FIGS. 5A and 5B illustrate fluctuations of the floating unit 68 corresponding to the toner quantity. When there is enough toner in the toner storage 60, the floating unit 68 and the magnet 69 are placed in the upper part as illustrated in FIG. 5A so that the empty sensor 70 is off. Even when the cam 65 rotates and swings the floating member 67, the floating unit 68 does not go lower than the upper surface level of toner. Thus, the empty sensor 70 is still off. When the quantity of toner in the toner storage 60 is reduced and the upper surface level of the toner is lowered, the floating member 704 and a magnet 704*c* are lowered to the lower part as illustrated in FIG. 5B so that the empty sensor 70 is switched on. If the cam 65 rotates and swings the floating member 67, movement of vertical direction of the floating unit 68 becomes large. The empty sensor 70 is switched on and off on a periodical basis. As the empty sensor 70 is on, it is detected that toner in the toner storage 60 is empty.

When the empty sensor 70 is switched on, the driving source 55 is driven, and the bottle unit 52 of the toner bottle 40 is rotated for a predetermined period (for instance, 10 seconds). As a result, toner is supplied to the sub-hopper 42 from the toner bottle 40. After toner is supplied to the sub-hopper 42, the upper surface level of toner in the toner storage 60 rises. Together with that, the magnet 69 rises. Thus, the empty sensor 70 is switched off from on. As the empty sensor 70 maintains the off state for more than the predetermined period, it can be detected that toner is appropriately supplied to the sub-hopper 42 from the toner bottle 40.

When there is no toner left in the toner bottle 40, toner is not supplied to the sub-hopper 42 even if the bottle unit 52 is rotated. In this case, the empty sensor 70 repeatedly switches between on and off, so it then can be detected that toner is not supplied to the sub-hopper 42. The empty sensor 70 may not maintain the off state even when the bottle unit 52 is rotated for the predetermined period (for instance, 10 seconds). In such a case, it is determined there is no toner left in the toner bottle 40.

The supply roller 62 supplies toner to the developing unit 34 to enable the toner density in the developing unit 34 to keep a predetermined value. The toner density sensor 38 detects the toner density in two-component developer filled in the developing unit 34, for example. When the toner density gets low, the supply roller 62 rotates to maintain the toner density at the predetermined value so that toner is supplied to the developing unit 34. A regular setting value for the toner density may be 5%. In this case, the supply roller 62 rotates if the toner density in the developing unit 34 is equal to or lower than 4.5%, and supplies toner to the developing unit 34 from the sub-hopper 42. When the toner density becomes 5%, the rotation of the supply roller 62 stops.

As described above, the image forming device 1 of the first embodiment enables toner to be supplied to the sub-hopper 42 from the toner bottle 40 and a predetermined quantity of toner to be stored in the sub-hopper 42. When the toner density in the developing unit 34 gets low, toner is supplied to the developing unit 34 from the sub-hopper 42.

Figure 6:
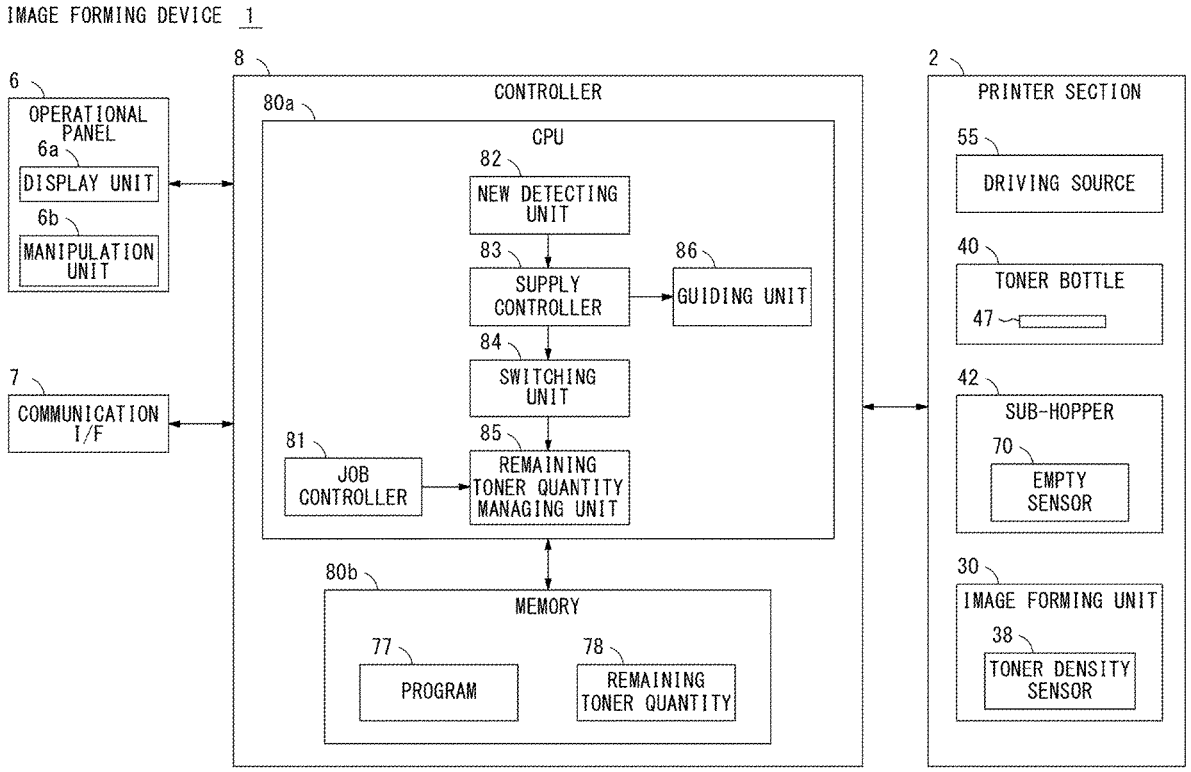
FIG. 6 illustrates a block diagram showing an example of a control structure of the image forming device.

A control structure that controls the image forming device 1 is explained next. FIG. 6 illustrates a block diagram showing an example of a control structure of the image forming device 1. The control structure of FIG. 6 shows the structure mainly controls operations of the printer section 2. As illustrated in FIG. 6, the image forming device 1 includes a controller 8 that controls the operations of the printer section 2. The controller 8 includes a CPU 80A and a memory 80*b*. The CPU 80A is a hardware processor that reads and executes a program 77 stored in the memory 80*b*. The memory 80*b* is a non-volatility storage formed from a hard disk drive (HDD) or a solid-state drive (SSD) in which a remaining toner quantity 78 of each toner bottle 40K, 40M, 40C and 40K is stored besides the program 77.

The controller 8 is connected to the operational panel 6 and a communication interface 7. The operational panel 6 includes a display unit 6*a* and a manipulation unit 6*b*. Various kinds of screens are displayed on the display unit 6*a*. The manipulation unit 6*b* receives an input by the user. The controller 8 is enabled to control the screen displayed on the display unit 6*a*. The controller 8 obtains operation information based on the user's operation via the manipulation unit 6*b*. The communication interface 7 connects the image forming device 1 to a network such as LAN (Local Area Network). The controller 8 is enabled to communicate with an external device connected to the network via the communication interface 7. When a print job is received from the external device via the communication interface 7, the image forming device 1 drives the printer section 2 based on the print job and controls an image forming operation for the sheet 9.

The CPU 80A of the controller 8 executes the program 77 so that it serves as a job controller 81, a new detecting unit 82, a supply controller 83, a switching unit 84, a remaining toner quantity managing unit 85 and a guiding unit 86.

The job controller 81 receives a job via the operational panel 6 or the communication interface 7, and controls the processing of the received job. When the print job is received, for instance, the job controller 81 controls the printer section 2 to control the operation to carry out the sheet 9 from the paper feeding tray 10 and form the image on the sheet 9 which is carried along the carrying path 11.

The new detecting unit 82 detects if the toner bottle 40 attached to the attaching unit 49 is new. The new detecting unit 82 becomes operative when a cause to replace the toner bottle occurs, for example, when an operation to open or close the door member 2*c* which is arranged on the front side of the printer section 2 is detected, when a main power of the image forming device 1 is turned on, or when a mode is recovered to a normal mode from a sleep mode which suppresses power consumption. To be more specific, as the cause to replace the toner bottle occurs, the toner bottle 40 attached to the printer section 2 might have been replaced. The new detecting unit 82 then detects if the toner bottle 40 attached to each attaching unit 49 is new. In the first embodiment, a new and old identifying member 47 is mounted on the toner bottle 40 attached and removed to and from the attaching unit 49 of the printer section 2. The new and old identifying member 47 maintains a new state if the toner bottle 40 is new and maintains an old state when the state is switched from new to old. As the cause to replace the toner bottle occurs, the new and old identifying member 47 of each toner bottle 40 is confirmed so that if the toner bottle 40 is new is detected.

Figure 7:
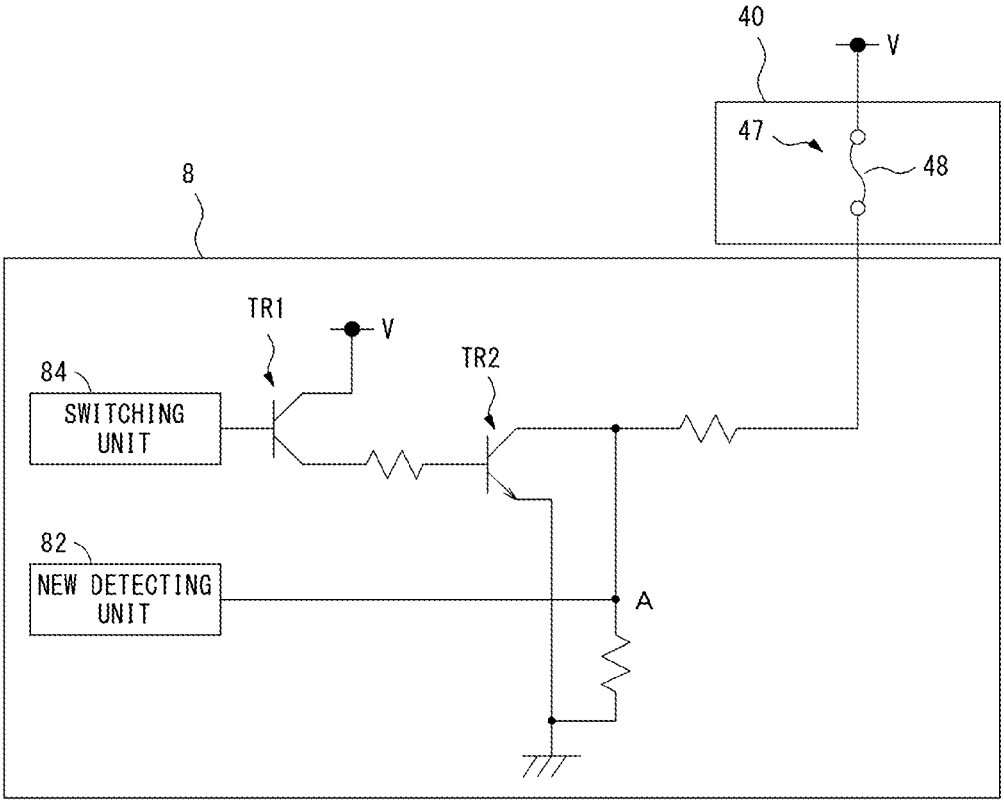
FIG. 7 illustrates a circuit diagram that shows a connection between a new and old identifying member of the toner bottle and a controller.

FIG. 7 illustrates a circuit diagram that shows a connection between the new and old identifying member 47 of the toner bottle 40 and the controller 8. As illustrated in FIG. 7, the toner bottle of the first embodiment is provided with a fuse 48 as the new and old identifying member 47. Once the toner bottle 40 is attached to the attaching unit 49, the electronical conduction is carried out between the fuse 48 and the controller 8. To be more specific, an end of the fuse 48 is connected to a predetermined voltage V and another end is connected to the new detecting unit 82 via a resistor. If the toner bottle 40 is new and is in a state at a time of shipping from a factory, the fuse 48 should be uncut. A voltage value obtained by dividing the predetermined voltage by multiple resistors appears at a detection point A by the new detecting unit 82. On the other hand, if the toner bottle 40 is old, the fuse 48 should have already been cut. Thus, the detection point A by the new detecting unit 82 shows grounding voltage and indicates a voltage value different from the new product.

FIG. 8 illustrates an example of the voltage at the detection point A before the fuse 48 is cut and after the fuse 48 is cut. As illustrated in FIG. 8, the toner bottle 40 may be new and the fuse 48 may have not been cut. In this case, the voltage at the detection point A is "HIGH." The toner bottle 40 may be old and the fuse 48 has already been cut. In this case, the voltage at the detection point A is "LOW." When the cause to replace the toner bottle occurs, the new detecting unit 82 measures the voltage at the detection point A. When the voltage at the detection point A is "HIGH," the new detecting unit 82 detects that the toner bottle 40 is new. On the other hand, when the voltage at the detection point A is "LOW," the new detecting unit 82 detects that the toner bottle 40 is old. The new detecting unit 82 does not cut the fuse 48 of the new toner bottle 40 even still it detects that the toner bottle 40 is new soon after the cause to replace the toner bottle occurs.

Referring back to FIG. 6, the supply controller 83 drives the driving source 55 to control the toner supplying operation to supply toner to the sub-hopper 42 from the toner bottle 40. The supply controller 83 becomes operative when the empty sensor 70 is turned on. The supply controller 83 drives the driving source 55 for a predetermined period to carry out the operation to supply toner from the toner bottle 40. The supply controller 83 also becomes operative when the new detecting unit 82 detects the toner bottle 40 is new. To be more specific, when the new detecting unit 82 detects that the toner bottle 40 is new, the supply controller 83 drives the driving source 55 for the predetermined period to carry out the toner supplying operation to supply toner to the sub-hopper 42 from the new toner bottle 40.

The new toner bottle 40 may not be stored in a good condition until the attachment to the printer section 2, or the user may attach the new toner bottle 40 to the printer section 2 without shaking it. In such a case, aggregation may occur and toner stored in the toner bottle 40 may become hard. Then, even still the supply controller 83 carries out the toner supplying operation, toner may not be normally supplied to the sub-hopper 42 from the new toner bottle 40. Thus, the supply controller 83 monitors if the empty state detected by the empty sensor 70 is released during the toner supplying operation from the new toner battle 40. More specifically, the supply controller 83 determines that the empty state has not been released when the empty sensor 70 does not maintain the off state and repeatedly switches between the on and off states. If the empty state of the sub-hopper 42 is released during the toner supplying operation from the new toner bottle 40, the supply controller 83 determines that toner is normally supplied to the sub-hopper 42 from the new toner bottle 40. The supply controller 83 then brings the switching unit 84 into operation.

The switching unit 84 switches the state of the toner bottle 40 to the new state from the old state if toner is normally supplied from the new toner bottle 40. More specifically, the switching unit 84 switches the new state of the new and old identifying member 47 mounted on the toner bottle 40 to the old state. The new and old identifying member 47 of the first embodiment mounted on the toner bottle 40 is the fuse 48. Thus, the switching unit 84 cuts the fuse 48 to switch the new state to the old state.

As illustrated in FIG. 7, the switching unit 84 is connected to the fuse 48 via multiple transistors TR1 and TR2. The switching unit 84 drives the multiple transistors TR1 and TR2 and sends an overcurrent to the fuse 48 so that the fuse 48 is cut. As a result, the toner bottle 48 shows the old state. The new detecting unit 82 does not detect the toner bottle 40 as a new product after that. After the state of the new toner bottle 40 is switched to the old state by the switching unit 84, the remaining toner quantity managing unit 85 becomes operative.

The remaining toner quantity managing unit 85 records the remaining toner quantity 78 of each toner bottle 40K, 40M, 40C and 40K to the memory 80*b* and manages. Once the processing of the print job is started by the job controller 81, the remaining toner quantity managing unit 85, for example, reduces the remaining toner quantity 78 of each toner bottle 40K, 40M, 40C and 40K in accordance with the number of the sheets 9 output due to the print job. The empty state of the sub-hopper 42 may not be released when the operation to supply toner to the sub-hopper 42 from the toner bottle 40 is carried out. The remaining toner quantity managing unit 85 then sets the remaining toner quantity 78 of the toner bottle 40 to "0." When the new toner bottle 40 is switched to the old state by the switching unit 84, the remaining toner quantity managing unit 85 updates the remaining toner quantity 78 of the toner bottle 40 to the full-up state.

If the empty state of the sub-hopper 42 is not released during the toner supplying operation from the new toner bottle 40, the supply controller 83 determines that toner is not normally supplied to the sub-hopper 42 from the new toner bottle 40. The supply controller 83 then brings the guiding unit 86 into operation. In this case, the switching unit 84 does not become operative so the state of the toner bottle 40 cannot be switched to the old state from the new state. The remaining toner quantity managing unit 85 does not become operative either so the remaining toner quantity 78 shown while the new toner bottle 40 is being attached is maintained.

The empty state of the sub-hopper 42 may not be released even still the operation to supply toner to the sub-hopper 42 from the new toner bottle 40 which is detected as the new product is carried out. In such a case, the guiding unit 86 gives a variety of guidance to the user. The guiding unit 86 displays, for instance, a variety of guidance screens on the display unit 6*a* of the operational panel 6, and gives the guidance to the user. The guiding unit 86 does not always display the guidance screen. The guiding unit 86 may give the voice guidance.

The guiding unit 86, for example, gives a guidance on an operation to once take the new toner bottle 40 out from the printer section 2 and attach it again to the printer section 2 after rapidly shaking it. The user who received the guidance takes the new toner bottle 40 out from the printer section 2 and attaches the toner bottle 40 again to the printer section 2 after rapidly shaking it. At this time, the door member 2*c* is opened and closed so the cause to replace the toner bottle occurs in the image forming device 1. The new detecting unit 82 then becomes operative again. The fuse 48 of the reattached toner bottle 40 has not been cut so that the new detecting unit 82 is enabled to detect the reattached toner bottle 40 as the new product.

Once the reattached toner bottle 40 is detected as the new product, the supply controller 83 carries out the operation to supply toner to the sub-hopper 42 from the new toner bottle 40. If the state of aggregation of toner stored in the toner bottle 40 is eliminated, toner is normally supplied to the sub-hopper 42 from the toner bottle 40, and the empty state of the sub-hopper 42 is released. As a result, the state of the toner bottle 40 is switched from the new state to the old state by the switching unit 84, and the remaining toner quantity 78 of the reattached toner bottle 40 is updated by the remaining toner quantity managing unit 85 to the full-up state.

The image forming device 1 of the first embodiment is enabled to appropriately detect the toner bottle 40 is new even when the new toner bottle 40 is once removed and reattached. If the reattached toner bottle 40 is new, the remaining toner quantity 78 can be reset to the full-up state at the time of the reattachment. This does not cause the conventional problems.

Figure 9:
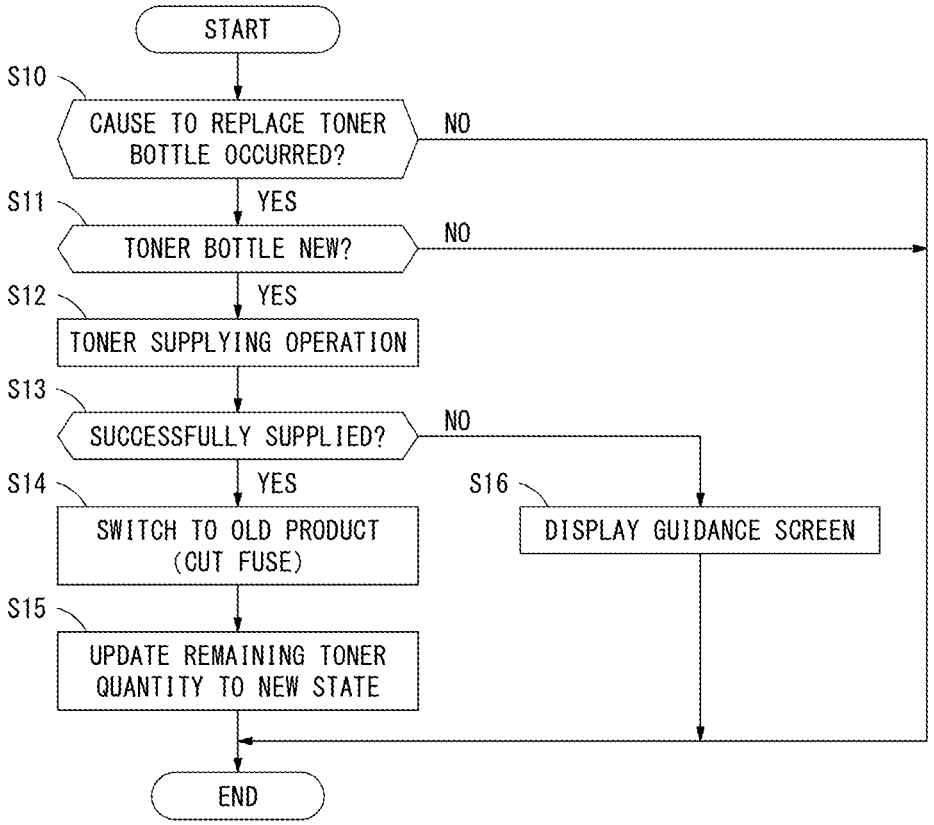
FIG. 9 illustrates a flow diagram explaining an exemplary procedure of a process carried out by the controller.

A process sequence performed by the controller 8 of the image forming device 1 is explained next. FIG. 9 illustrates a flow diagram explaining an exemplary procedure of the process carried out by the controller 8. The process is repeatedly carried out by the controller 8. Once the process starts, the controller 8 determines if the cause to replace the toner bottle has occurred (step S10). If the cause to replace the toner bottle has not occurred (when a result of step S10 is NO), the process by the controller 8 completes.

The cause to replace the toner bottle may have occurred (when a result of step S10 is YES). In this case, the controller 8 confirms if the fuse 48 mounted on each of the multiple toner bottles 40 has not been cut, and determines if each toner bottle 40 is new (step S11). If there is no new toner bottle 40 (when a result of step S11 is NO), the process by the controller 8 completes.

When there is the new toner bottle 40 (when a result of step S11 is YES), the controller 8 carries out the operation to supply toner to the sub-hopper 42 from the toner bottle 40 detected as the new product (step S12). To be more specific, the controller 8 drives the driving source 55 to rotate the bottle unit 52 of the new toner bottle 40 for the predetermined period (for example, 10 seconds), and supplies toner to the sub-hopper 42 from the new toner bottle 40.

While the operation to supply toner to the sub-hopper 42 from the new toner bottle 40 is carried out, the door member 2*c* may be opened, for example. In such a case, a cause to interrupt the operation to supply toner occurs. As an example of the cause to interrupt the operation to supply toner is that turning off the main power besides opening of the door member 2*c*. Once the cause to interrupt the operation to supply toner occurs, the controller 8 interrupts the toner supplying operation. In interruption of the operation, the controller 8 stores a time took for carrying out the toner supplying operation until the interruption (hereafter, carrying out time) in the memory 80*b*. When the cause to interrupt is resolved, the controller 8 reads the carrying out time in the memory 80*b*, and restarts the toner supplying operation from the middle of the operation. As a result, the period to carry out the operation to supply toner to the sub-hopper 42 from the new toner bottle 40 can be maintained for the predetermined period (for instance, 10 seconds) before and after the occurrence of the cause to interrupt. This can suppress the excess supply of the toner quantity to the sub-hopper 42.

The controller 8 determines if toner is successfully supplied to the sub-hopper 42 from the new toner bottle 40 through the toner supplying operation (step S13).

When toner is successfully supplied to the sub-hopper 42 from the new toner bottle 40 (when a result of step S13 is YES), the controller 8 switches the new toner bottle 40 to the old product (step S14). More specifically, the controller 8 cuts the fuse 48 mounted on the new toner bottle 40. The controller 8 then updates the remaining toner quantity 78 of the toner bottle 40, the fuse 48 of which is cut, to a full-up state which corresponds to the new state (step S15).

When the remaining toner quantity of each toner bottle 40 is displayed on the display unit 6*a* of the operational panel 6, the remaining toner quantity displayed on the display unit 6*a* is also updated as well as the remaining toner quantity 78 stored in the memory 80*b* is updated in step S15.

Figure 10A:
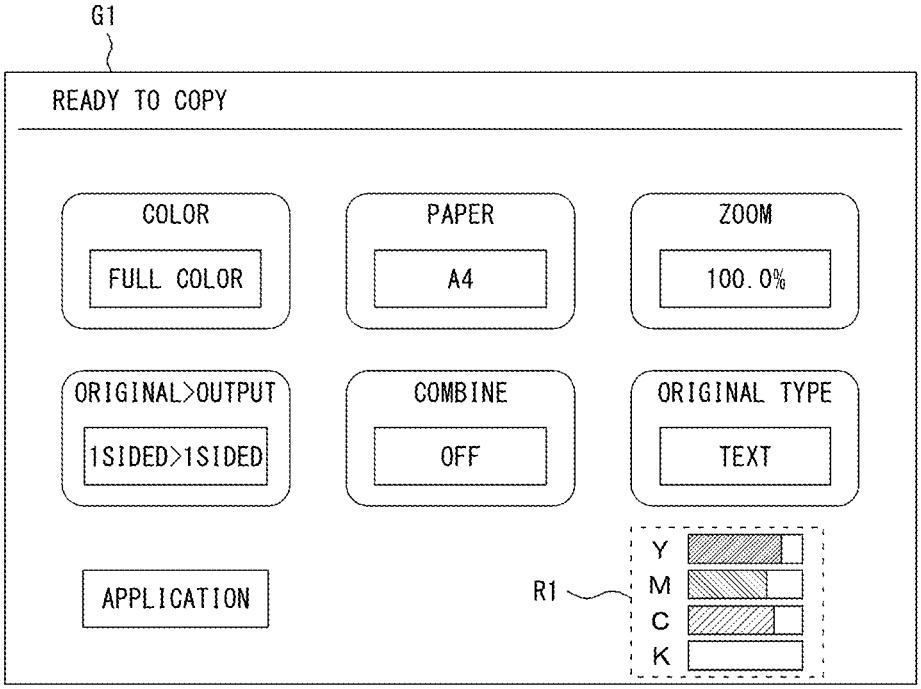
FIGS. 10A and 10B illustrate an example of update of a remaining toner quantity displayed on a screen of a display unit.
Figure 10B:
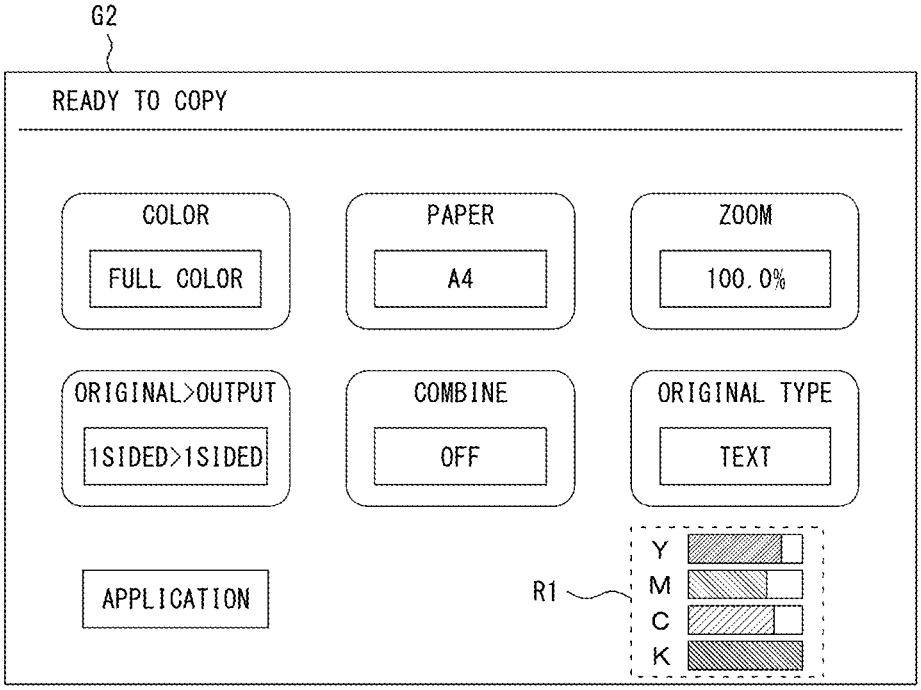

FIGS. 10A and 10B illustrate an example of the update of the remaining toner quantity displayed on a screen of the display unit 6*a*. In a screen G1 of FIG. 10A, the remaining toner quantity of the toner bottle 40K corresponding to color K shows 0. In this case, a guidance of a replacement of the toner bottle 40K corresponding to color K is made to the user, and the toner bottle 40K is replaced by the user to the new one. If toner is successfully supplied to the sub-hopper 42K from the new toner bottle 40K attached to the printer section 2, the state of the new toner bottle 40K is switched to the old product. The remaining toner quantity 78 is updated to the full-up state. Together with this, the screen G1 of the display unit 6*a* is updated to the screen G2 as illustrated in FIG. 10B. In the screen of FIG. 10B, the remaining toner quantity of the toner bottle 40K corresponding to color K shows the full-up state, and the user is enabled to know that the replacement of the toner bottle 40K is normally carried out.

When the toner supply to the sub-hopper 42 from the new toner bottle 4 is failed (when a result of step S13 is NO), the controller 8 displays the screen to give a guidance of the operation to once take the new toner bottle 40 out of the printer section 2 and reattach the new toner bottle 40 to the printer section 2 after rapidly shaking it (step S16).

Figure 11:
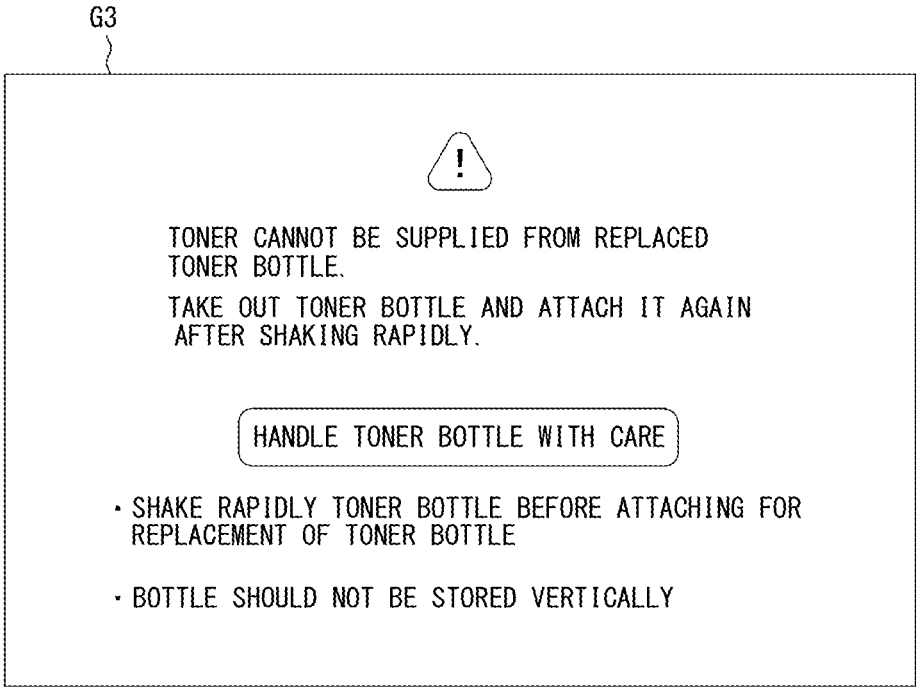
FIG. 11 illustrates an example of a guidance screen.

FIG. 11 illustrates an example of a guidance screen G3 displayed in the step S16. As the guidance screen G3 of FIG. 11 is displayed on the display unit 6*a*, the user notices that he or she had not been shaking the toner bottle 40 at the attachment of the toner bottle 40. The user then once takes the new toner bottle 40 out of the printer section 2 and reattaches the new toner bottle 40 after rapidly shaking it as guided by the guidance screen G3. As a result, at the reattachment of the toner bottle 40, the aggregation of toner stored in the toner bottle 40 can be eliminated.

As the toner bottle 40 is reattached by the user, the controller 8 carries out the process after step S10. Once the aggregation of toner stored in the new toner bottle 40 is eliminated, toner is successfully supplied to the sub-hopper 42 from the toner bottle 40 (when a result of step S13 is YES). The state of the toner bottle 40 is switched to the old state from the new state (step S14), in addition, the remaining toner quantity of the reattached toner bottle 40 is updated to the full-up state (step S15). Thus, the process carried out by the controller 8 completes.

Figure 12:
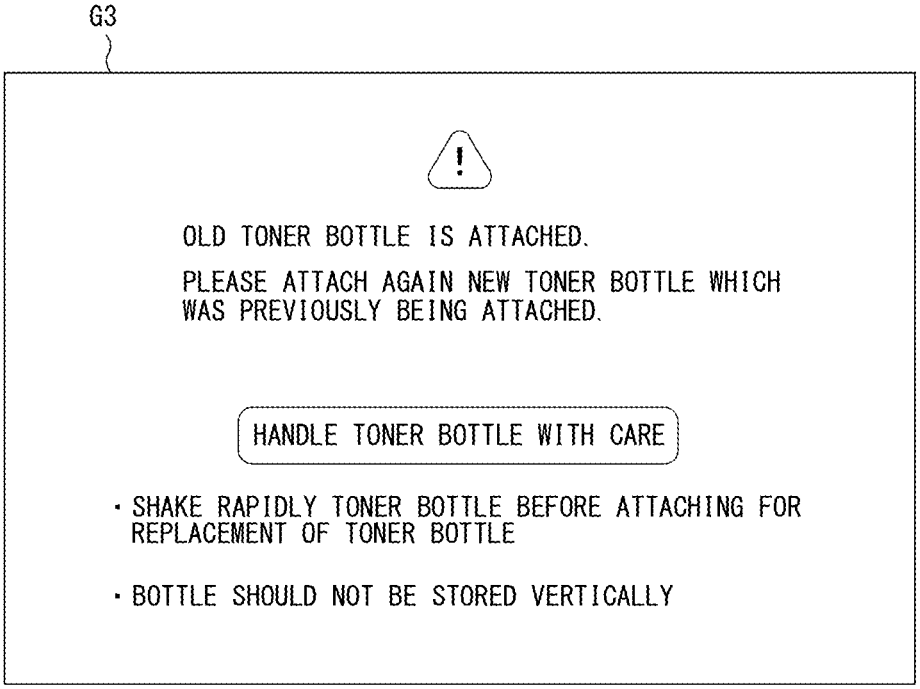
FIG. 12 illustrates another example of the guidance screen.

After the guidance screen G3 of FIG. 11 is displayed, the old toner bottle 40 may be reattached by the user. In such a case, the fuse 48 of the toner bottle 40 has been cut so the new detecting unit 82 detects that the reattached toner bottle 40 is the old product. Even still some toner is left in the reattached old toner bottle 40, the remaining toner quantity managing unit 85 cannot gasp the remaining toner quantity. Hence, the accurate remaining toner quantity cannot be displayed on the display unit 6*a*. If the toner bottle 40 reattached while the guidance screen G3 of FIG. 11 is displayed is the old product, a guidance screen G4 of FIG. 12 may be displayed on the display unit 6*a*. To be more specific, when the reattachment of the old toner bottle 40 is detected, the controller 8 gives again a guidance to the user of reattachment of the new toner bottle 40 which was previously attached. The display of the guidance screen G4 enables the user to replace the old toner bottle 40 with the new toner bottle 40. As a result, an occurrence of the situation that the remaining toner quantity managing unit 85 cannot manage the remaining toner quantity of the reattached toner bottle 40 can be prevented.

Figure 13:
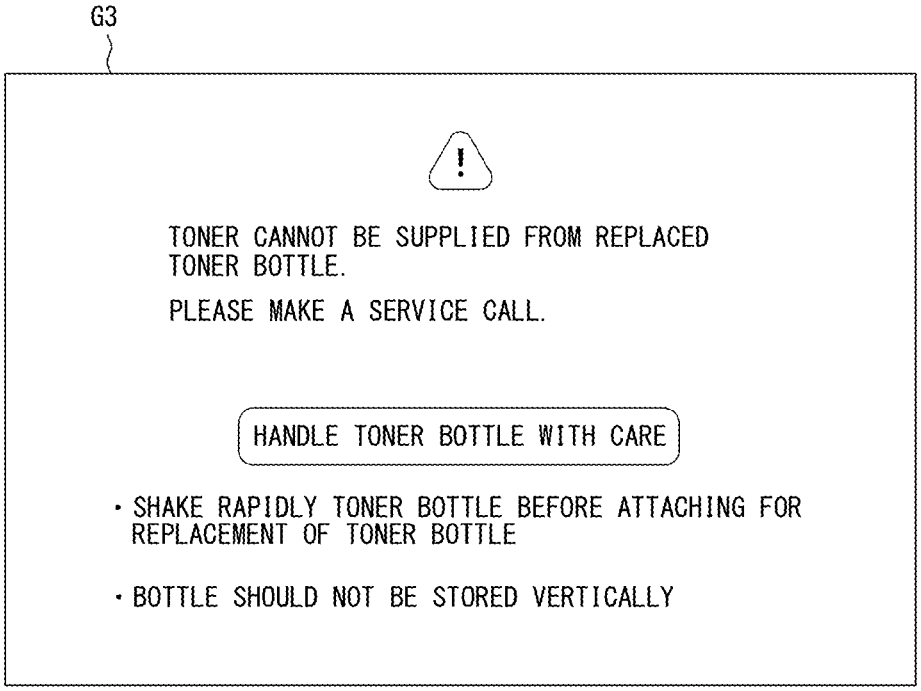
FIG. 13 illustrates even another example of the guidance screen.

Even when the new toner bottle 40 is reattached by the user, toner supply to the sub-hopper 42 from the new toner bottle 40 may fail. In this case, the controller 8 displays again the guidance screen as illustrated in FIG. 11 on the display unit 6*a*. Even when the user shakes the new toner bottle 40 rapidly and reattaches the toner bottle 40 multiple times, toner may not be normally supplied from the toner bottle 40. In such a case, it can be said that there is an abnormality in toner stored in the toner bottle 40. The controller 8 then may display a guidance screen G5 as illustrated in FIG. 13 on the display unit 6*a*. More specifically, even after the reattachment of the new toner bottle 40 is performed by the user for several times, the empty state of the sub-hopper 42 may still not be canceled. In this case, a guidance to make a call to a service center is given to the user. The guidance screen G5 is displayed so that the user is enabled to make a call to the service center and obtain another new toner bottle 40.

Figure 14:
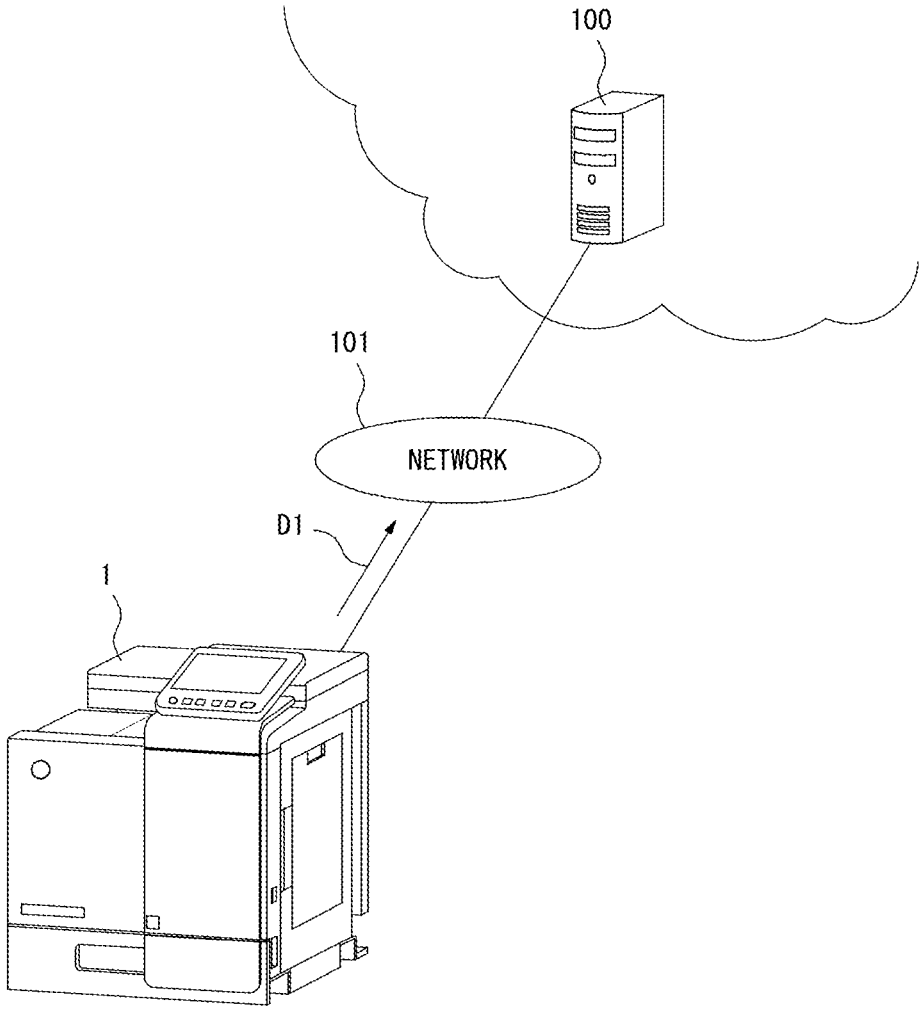
FIG. 14 illustrates an exemplary structure for the image forming device to send a notification to a server.

The empty state of the sub-hopper 42 may not be released even after the new toner bottle 40 is reattached several times by the user. In such a case, the controller 8 may send a notification D1 indicating that there is an abnormality in the toner bottle 40 to a predetermined server 100 via a network 101 as illustrated in FIG. 14. The server 100 is a server installed on a cloud such as internet, for instance, and is operated by an agent such as a maintenance provider for the image forming device 1. The user is enabled to obtain another new toner bottle 40 without making the service call by himself/herself.

Second Embodiment

The second embodiment of the present disclosure is explained next. The new and old identifying member 47 mounted on the toner bottle 40 is the fuse 48 in the above-described first embodiment. A storage 46 formed from a semiconductor memory is mounted on the toner bottle 40 as the new and old identifying member 47 in the second embodiment.

Figure 15:
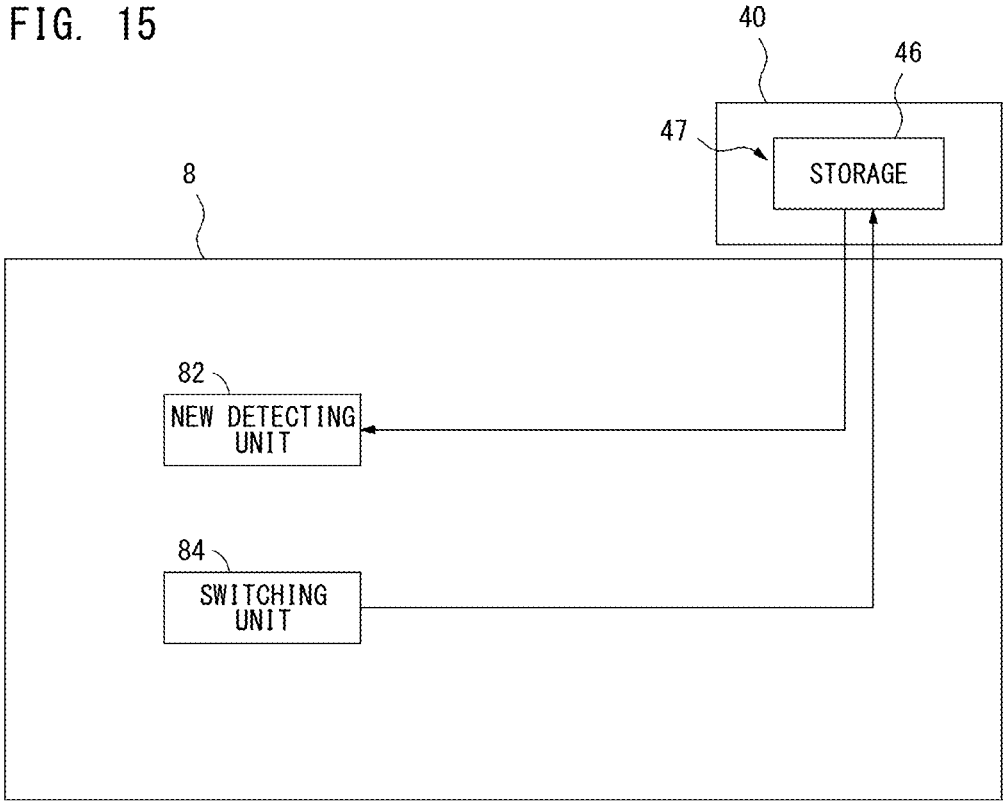
FIG. 15 illustrates another example of the circuit diagram that shows the connection between the new and old identifying member of the toner bottle and the controller.

FIG. 15 illustrates an example of a connection between the new and old identifying member 47 of the toner bottle 40 and the controller 8. The storage 46 is provided with the toner bottle 40. The storage 46 is a non-volatility storage that can electrically rewrite stored information. The storage 46 is, for example, EEPROM, IChip or CSIC. When the toner bottle 40 is new, new product information is written in the storage 46 at a time of shipping from a factory. At the time of an occurrence of the cause to replace the toner bottle, the new detecting unit 82 reads the information in the storage 46 and determines if the information is the new product information. If the information is the new product information, the new detecting unit 82 detects that the toner bottle 40 is new.

When toner is normally supplied to the sub-hopper 42 from the new toner bottle 40, the switching unit 84 rewrites the new product information stored in the storage 46 to old product information. The switching unit 84 then switches the state of the toner bottle from the new state to the old state. After this switching, the new detecting unit 82 detects the toner bottle 40 as the old product.

As described above, the image forming device 1 of the second embodiment uses the storage 46 for the fuse 48 which is described in the first embodiment. Except for the point that the storage 46 is used for the fuse 48, the image forming device 1 of the second embodiment is the same as one explained in the first embodiment. The image forming device 1 of the second embodiment has the same effect as the image forming device 1 of the first embodiment.

Although the embodiments of the present disclosure have been described and illustrated in detail, it is clearly understood that the same is by way of illustration and example only and not limitation, the scope of the present disclosure should be interpreted by terms of the appended claims.

(Modifications)

While the preferred embodiments of the present disclosure have been described above, the present disclosure is not limited to the preferred embodiments. Various modifications may be applied to the present disclosure.

In the above-described embodiments, toner is supplied to the toner storage 60 of the sub-hopper 42 from the toner bottle 40. There, however, is the image forming device 1 that is not provided with the sub-hopper 42. In this case, toner is directly supplied to the developing unit 34 from the toner bottle 40. The aforementioned toner storage 60 is arranged inside the developing unit 34. Even when the toner storage 60 is arranged inside the developing unit 34, the above-described control can be applied.

The image forming device 1 of the above-described embodiments is a color device that can form color images on the sheet 9. However, this is given not for limitation. The image forming device 1 may be a black and white device.

As used herein, the words "can" and "may" are used in a permissive (i.e., meaning having the potential to), rather than mandatory sense (i.e., meaning must). The words "include," "includes," "including," and the like mean including, but not limited to. Similarly, the singular form of "a" and "the" include plural references unless the context clearly dictates otherwise. And the term "number" shall mean one or an integer greater than one (i.e., a plurality).

What is claimed is:

1. An image forming device, comprising:

an attaching unit to which a removable toner bottle is attached;

a toner storage that stores toner supplied from the toner bottle attached to the attaching unit;

a detector that detects an empty state of toner in the toner storage; and a hardware processor that:

supplies toner to the toner storage from the toner bottle when the toner bottle attached to the attaching unit is new; and switches a state of the toner bottle to an old state from a new state if the empty state detected by the detector is released.

2. The image forming device according to claim 1, wherein the hardware processor updates a remaining quantity of the toner bottle to a remaining quantity at the time of the new state when the state of the toner bottle is switched to the old state from the new state.

3. The image forming device according to claim 1, wherein the hardware processor maintains the remaining quantity which was shown before the new toner bottle is attached as the remaining quantity of the toner bottle when the toner bottle attached to the attaching unit is new and the state of the toner bottle is not switched from the new state to the old state.

4. The image forming device according to claim 1, further comprising:

a new and old identifying member that:

maintains the new state when the toner bottle is new; and maintains the old state when the state is switched from the new state to the old state, wherein the hardware processor switches the state maintained by the new and old identifying member from the new state to the old state.

5. The image forming device according to claim 4, wherein the new and old identifying member includes a fuse, and wherein the hardware processor switches the state of the toner bottle from the new state to the old state when the fuse is cut.

6. The image forming device according to claim 4, wherein the new and old identifying member includes a storage, and wherein the hardware processor rewrites new product information to old product information stored in the storage to switch the state of the toner bottle from the new state to the old state.

7. The image forming device according to claim 6, wherein the storage is an electrically rewritable non-volatility memory.

8. The image forming device according to claim 1, further comprising:

a developing unit that develops an electrostatic latent image, wherein the toner storage is a sub-hopper that stores toner supplied from the toner bottle and supplies the toner to the developing unit.

9. The image forming device according to claim 1, further comprising:

a developing unit that develops an electrostatic latent image, wherein the toner storage is arranged inside the developing unit.

10. The image forming device according to claim 1, wherein the hardware processor gives a guidance of reattachment of the toner bottle to a user when the empty state detected by the detector is not released after toner is supplied to the toner storage from the new toner bottle.

11. The image forming device according to claim 1, wherein the hardware processor gives the guidance to the user of reattachment of the new toner bottle which was previously being attached when the empty state detected by the detector is not released after toner is supplied to the toner storage from the new toner bottle and the attachment of the old toner bottle to the attaching unit is detected.

12. The image forming device according to claim 1, wherein the hardware processor gives a guidance to the user to make a service call when the empty state detected by the detector is not released after toner is supplied to the toner storage from the new toner bottle and the detected empty state is not released even after the toner bottle is reattached predetermined times by the user.

13. The image forming device according to claim 10, further comprising:

a display unit on which various kinds of screens are displayed to the user, wherein the hardware processor displays a guidance screen on the display unit to make the guidance to the user.

14. The image forming device according to claim 1, wherein the hardware processor notifies a predetermined server of an abnormality when the empty state detected by the detector is not released after toner is supplied to the toner storage from the new toner bottle and the detected empty state is not released even after the toner bottle is reattached predetermined times by the user.

15. The image forming device according to claim 1, wherein the hardware processor:

interrupts an operation to supply toner to the toner storage from the toner bottle if a certain cause to interrupt occurs during the operation which is carried out after detection that the toner bottle attached to the attaching unit is new; and restarts the operation after the cause to interrupt is solved.

16. A controlling method applied in an image forming device, comprising:

an attaching unit to which a removable toner bottle is attached;

a toner storage that stores toner supplied from the toner bottle attached to the attaching unit; and a detector that detects an empty state of toner in the toner storage, wherein the method comprises:

supplying toner to the toner storage from the toner bottle when the toner bottle attached to the attaching unit is new; and switching a state of the toner bottle to an old state from a new state if the empty state detected by the detector is released.

17. The controlling method according to claim 16, further comprising:

updating a remaining quantity of the toner bottle to a remaining quantity at the time of the new state when the state of the toner bottle is switched to the old state from the new state.

18. The controlling method according to claim 16, further comprising:

maintaining the remaining quantity which was shown before the new toner bottle is attached as the remaining quantity of the toner bottle when the toner bottle attached to the attaching unit is new and the state of the toner bottle is not switched from the new state to the old state.

19. The controlling method according to claim 16, wherein the toner bottle comprises a new and old identifying member that:

maintains the new state when the toner bottle is new; and maintains the old state when the state is switched from the new state to the old state, and wherein the state maintained by the new and old identifying member is switched from the new state to the old state.

20. The controlling method according to claim 19, wherein the new and old identifying member includes a fuse, and wherein the state of the toner bottle is switched from the new state to the old state when the fuse is cut.

21. The controlling method according to claim 19, wherein the new and old identifying member includes a storage, and wherein new product information stored in the storage is written to old product information so that the state of the toner bottle is switched to the old state from the new state.

22. The controlling method according to claim 16, further comprising:

giving a guidance of reattachment of the toner bottle to a user when the empty state detected by the detector is not released after toner is supplied to the toner storage from the new toner bottle.

23. The controlling method according to claim 16, further comprising:

giving the guidance to the user of reattachment of the new toner bottle which was previously being attached when the empty state detected by the detector is not released after toner is supplied to the toner storage from the new toner bottle and the attachment of the old toner bottle to the attaching unit is detected.

24. The controlling method according to claim 16, further comprising:

giving a guidance to the user to make a service call when the empty state detected by the detector is not released after toner is supplied to the toner storage from the new toner bottle and the detected empty state is not released even after the toner bottle is reattached predetermined times by the user.

25. The controlling method according to claim 22, wherein the image forming device further comprising a display unit on which various kinds of screens are displayed to the user, and wherein a guidance screen is displayed on the display unit when the guidance is given to the user.

26. The controlling method according to claim 16, further comprising:

notifying a predetermined server of an abnormality when the empty state detected by the detector is not released after toner is supplied to the toner storage from the new toner bottle and the detected empty state is not released even after the toner bottle is reattached predetermined times by the user.

27. The controlling method according to claim 16, wherein an operation to supply toner to the toner storage from the toner bottle is interrupted if a certain cause to interrupt occurs during the operation which is carried out after detection that the toner bottle attached to the attaching unit is new; and wherein the operation is restarted after the cause to interrupt is solved.

* * * * *